US008939665B2

(12) United States Patent
Van Britsom et al.

(10) Patent No.: US 8,939,665 B2
(45) Date of Patent: Jan. 27, 2015

(54) CASSETTE FOR USE IN A LABEL PRINTER

(75) Inventors: Dirk Van Britsom, Temse (BE); Stefaan Van Den Broecke, Ghent (BE); Kris Vandermeulen, Bornem (BE); Peter Van Pottelberghe, Belsele (BE)

(73) Assignee: Dymo, Sint-Niklaas (BE)

( * ) Notice: Subject to any disclaimer, the term of this patent is extended or adjusted under 35 U.S.C. 154(b) by 0 days.

(21) Appl. No.: 13/318,031

(22) PCT Filed: Apr. 28, 2010

(86) PCT No.: PCT/EP2010/055766

§ 371 (c)(1),
(2), (4) Date: Nov. 18, 2011

(87) PCT Pub. No.: WO2010/125126

PCT Pub. Date: Nov. 4, 2010

(65) Prior Publication Data

US 2012/0057917 A1 Mar. 8, 2012

(30) Foreign Application Priority Data

| | | |
|---|---|---|
| Apr. 28, 2009 | (GB) | 0907280.2 |
| Apr. 28, 2009 | (GB) | 0907281.0 |
| Oct. 30, 2009 | (GB) | 0919126.3 |

(51) Int. Cl.

| | |
|---|---|
| ***B41J 15/00*** | (2006.01) |
| ***B41J 35/28*** | (2006.01) |
| ***B41J 3/36*** | (2006.01) |
| ***B41J 3/39*** | (2006.01) |
| ***B41J 15/04*** | (2006.01) |
| ***B41J 17/32*** | (2006.01) |

(52) U.S. Cl.
CPC ..... *B41J 15/044* (2013.01); *B41J 15/04* (2013.01); *B41J 17/32* (2013.01)
USPC ..... 400/613; 400/88; 400/208

(58) Field of Classification Search
USPC ..... 400/613, 88, 208
See application file for complete search history.

(56) References Cited

U.S. PATENT DOCUMENTS

| | | | |
|---|---|---|---|
| 3,861,611 | A | 1/1975 | Esashi et al. |
| 4,884,159 | A | 11/1989 | Satoh |
| 4,915,516 | A | 4/1990 | Shimizu et al. |

(Continued)

FOREIGN PATENT DOCUMENTS

| | | | |
|---|---|---|---|
| DE | 34 05 164 | A1 | 8/1985 |
| EP | 0 395 320 | A1 | 10/1990 |

(Continued)

OTHER PUBLICATIONS

Search Report for Application No. BE 201000586, dated Jun. 28, 2012.

(Continued)

*Primary Examiner* — David Banh
(74) *Attorney, Agent, or Firm* — Marshall, Gerstein & Borun LLP

(57) ABSTRACT

A label printer cassette is provided. Said label printer cassette comprises at least one supply of printing medium and a housing. The housing comprises a first surface, a second surface, said second surface being opposite said first surface, and at least one side extending between said first and second surfaces, one side having a switch operating arrangement having a ramped surface which is configured, in use to operate a switch of a label printer.

13 Claims, 13 Drawing Sheets

(56) References Cited

U.S. PATENT DOCUMENTS

| | | | | | |
|---|---|---|---|---|---|
| 4,977,429 | A | | 12/1990 | Tani et al. | |
| 4,998,220 | A | | 3/1991 | Eitan et al. | |
| 5,253,334 | A | | 10/1993 | Kimura et al. | |
| RE34,521 | E | * | 1/1994 | Shimizu et al. | 400/208 |
| 5,333,959 | A | | 8/1994 | Yamaguchi et al. | |
| 5,365,312 | A | | 11/1994 | Hillmann et al. | |
| 5,492,420 | A | | 2/1996 | Nunokawa et al. | |
| 5,518,328 | A | * | 5/1996 | Okuchi et al. | 400/208 |
| 5,540,510 | A | * | 7/1996 | Sims et al. | 400/208 |
| 5,559,577 | A | | 9/1996 | Miyazawa et al. | |
| 5,605,404 | A | | 2/1997 | Nunokawa et al. | |
| 5,727,888 | A | * | 3/1998 | Sugimoto et al. | 400/586 |
| 5,765,954 | A | | 6/1998 | Nunokawa et al. | |
| 5,823,689 | A | | 10/1998 | Nehowig et al. | |
| 5,921,688 | A | | 7/1999 | Furuya et al. | |
| 5,997,194 | A | | 12/1999 | Nunokawa et al. | |
| 6,042,280 | A | * | 3/2000 | Yamaguchi et al. | 400/120.16 |
| 6,092,946 | A | | 7/2000 | Cockerill et al. | |
| 6,371,670 | B1 | | 4/2002 | Kojo | |
| 6,449,004 | B1 | * | 9/2002 | Okisu et al. | 348/44 |
| 6,603,567 | B1 | | 8/2003 | Itoh et al. | |
| 2004/0218957 | A1 | * | 11/2004 | Cockerill et al. | 400/88 |
| 2006/0165461 | A1 | | 7/2006 | Vandermeulen et al. | |
| 2008/0050160 | A1 | * | 2/2008 | Yamaguchi et al. | 400/76 |
| 2010/0272492 | A1 | | 10/2010 | Van Britsom et al. | |
| 2012/0057917 | A1 | | 3/2012 | Van Britsom et al. | |

FOREIGN PATENT DOCUMENTS

| | | | | | |
|---|---|---|---|---|---|
| EP | 0497352 | A2 | | 8/1992 | |
| EP | 0629509 | A2 | | 12/1994 | |
| EP | 1 084 852 | A1 | | 3/2001 | |
| EP | 1 099 561 | A2 | | 5/2001 | |
| EP | 0 958 927 | B1 | | 10/2003 | |
| EP | 1 707 395 | B1 | | 11/2009 | |
| EP | 2 415 611 | A1 | | 2/2012 | |
| EP | 2 246 197 | B1 | | 8/2012 | |
| GB | 2211173 | A | | 6/1989 | |
| GB | 2 311 765 | A | | 10/1997 | |
| GB | 2 459 531 | B | | 10/2010 | |
| JP | 61-164872 | A | | 7/1986 | |
| JP | 62-060680 | A | | 3/1987 | |
| JP | 62292474 | A | * | 12/1987 | B41J 32/00 |
| JP | 02-200474 | A | | 8/1990 | |
| JP | 04-246583 | A | | 9/1992 | |
| JP | H05213458 | A | | 8/1993 | |
| JP | H08118738 | A | | 5/1996 | |
| JP | 9-109500 | A | | 4/1997 | |
| JP | 9277630 | A | | 10/1997 | |
| JP | 2000001225 | A | | 1/2000 | |
| JP | 2000229750 | A | | 8/2000 | |
| JP | 2002-127533 | A | | 5/2002 | |
| JP | 2008-158914 | A | | 7/2008 | |
| NL | 7 212 637 | A | | 3/1973 | |
| WO | WO-90/00974 | A1 | | 2/1990 | |
| WO | WO-2006/013466 | A2 | | 2/2006 | |
| WO | WO-2007/057779 | A3 | | 9/2007 | |
| WO | WO-2010/125127 | A1 | | 11/2010 | |

OTHER PUBLICATIONS

Search Report for Application No. BE 201000587, dated Jul. 2, 2012.
Search Report for Application No. BE 201000588, dated Jul. 16, 2012.
European Search Report for Application No. 10161329.7, dated Jul. 5, 2010.
International Search Report and Written Opinion for Application No. PCT/EP2010/055753, dated Jun. 29, 2010.
Search Report for Application No. BE 201000589, dated Jul. 12, 2012.
International Search Report for PCT/EP2010/055766, mailed Apr. 10, 2010.
Japanese Office Action for Patent Application No. 2012-507736, dated Feb. 4, 2014. (With Translation).
Notification of the Second Office Action for Chinese Application No. 201080027790.2, dated Mar. 3, 2014.
Notice of Reason for Rejection for JP Patent Application No. 2012-507739, dated Oct. 18, 2013.
Belgium Search Report and Written Opinion for Application No. BE201300001, dated Jun. 13, 2013.

* cited by examiner

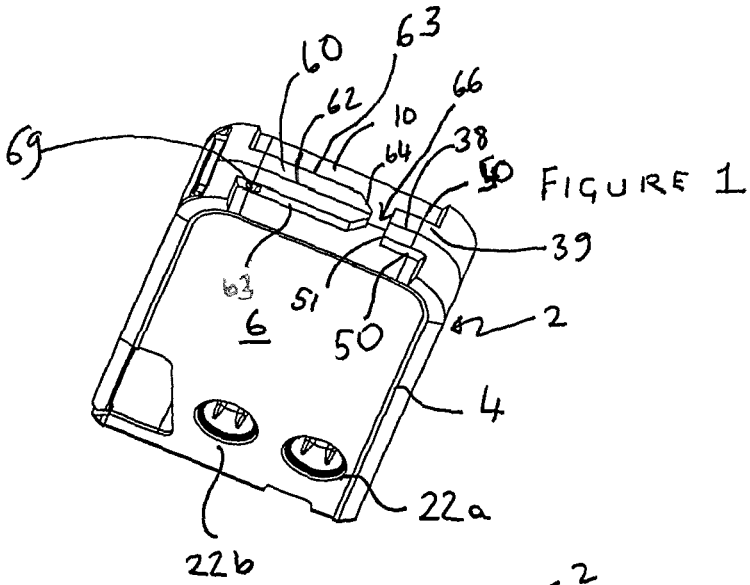
FIGURE 1
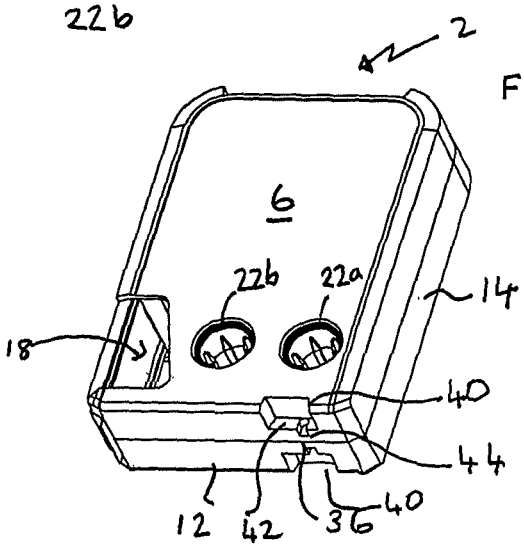
FIGURE 2
FIGURE 3
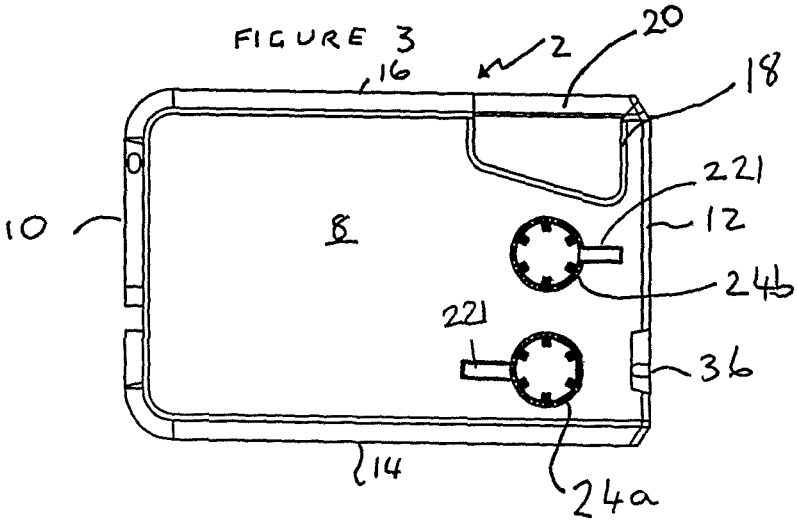

30b
2
54a
69
74

SECTION D-D
30a
2
54a
69
74

30b
2
54b
E
70
72
63
F

SECTION A-A
30a
2
54a
E
70
F
72
63

30b
2
54b
42
46
50
52

SECTION B-B
30a
2
54a
50
52
42
46

30b
2
54b
48
50
52

SECTION C-C
30a
2
54a
50
52
48

332

73
72
70
74
52
54b
326
328
324
30b
322
332

73
72
70
73
74
52
54a
324
322
326
325
30a

CASSETTE FOR USE IN A LABEL PRINTER

REFERENCE TO RELATED APPLICATIONS

This application is the US National Phase under 35 USC §371 of International Patent Application No. PCT/EP2010/055766, filed Apr. 28, 2010, and claims priority to GB 0907281.0 filed Apr. 28, 2009, GB 0907280.2 filed Apr. 28, 2009, and GB 0919126.3 filed Oct. 30, 2009. The entire specifications of each of the above-identified documents are incorporated herein by reference.

FIELD OF THE DISCLOSURE

The present disclosure relates to a cassette for use in a label printer, to a label printer, and to a combination of a cassette and a label printer.

BACKGROUND

A label printer generally comprises a printhead which is controlled to print onto an image receiving tape medium or onto a consumable in the form of a continuous backing sheet on which pre-cut labels are provided. The image receiving medium is generally provided in a cassette which is received in a cassette receiving bay of the label printer.

Some manufacturers of label printers may provide more than one model of label printer and/or may want to update a current model. However, it is inconvenient and potentially confusing to a consumer if each different label printer has a different cassette. Currently, the design of new label printers is typically constrained by the current design of the cassette provided by that manufacturer.

Some label printers are provided with a switch at the bottom of the cassette receiving bay. The position of the switch is controlled by the cassette in dependence on the characteristics of the image receiving medium in the cassette. This requires the cassette and cassette receiving bay to have sufficient dimensions to accommodate the switch and the switch operating surfaces of the cassette.

The cassette may house an image receiving medium and an ink ribbon. The relative arrangement of these components in the cassette, for example in relation to a print area influences the size of the cassette and the label printer.

SUMMARY OF THE DISCLOSURE

According to a first aspect of the present disclosure, there is provided a label printer cassette comprising: at least one supply of printing medium; a housing, said housing comprising a first surface, a second surface, said second surface being opposite said first surface, and at least one side extending between said first and second surfaces, one side having a switch operating arrangement having a ramped surface which is configured, in use to operate a switch of a label printer.

According to a second aspect, there is provided a label printer cassette comprising: a housing, said housing comprising a first surface, a second surface, said second surface being opposite said first surface, a first side, a second side, a third side and a fourth side, said first, second, third and fourth sides extending between said first and second surfaces, said housing comprising a first part and a second part, said first and second parts being substantially symmetric on at least one of said first, second, third and fourth sides about a plane extending between said first and second surfaces; and at least one supply of printing medium.

According to a third aspect, there is provided a label printer cassette comprising; a supply of image receiving medium; a supply of ink ribbon; an ink ribbon take up spool; a print area for receiving at least part of a print mechanism of said label printer, wherein said supply of ink ribbon, said ink ribbon take up spool and said print area are linearly arranged.

According to a fourth aspect, there is provided a subassembly for use in a label printer cassette comprising: a supply of ink ribbon; an ink ribbon take up spool; a print area for receiving at least part of a print mechanism of said label printer, wherein said supply of ink ribbon, said ink ribbon take up spool and said print area are linearly arranged.

According to a fifth aspect, there is provided a label printer comprising; a cassette receiving bay configured to receive a cassette, a print head arranged in the cassette receiving bay; a platen arranged in the cassette receiving bay; wherein said cassette receiving bay has a shape corresponding generally to the outline of a cassette and further having a first gripping area and a second gripping area, said first and second areas being opposite one another and being configured such that in use, a cassette can be gripped by a user on either side of the cassette in said gripping areas.

According to a sixth aspect, there is provide a cassette with a first part and a second part, the first part comprising a an image receiving medium supply, and the second part comprising a subassembly wherein the subassembly comprises a print area, an ink ribbon supply spool and an ink ribbon take-up spool.

According to a seventh aspect, there is provided a label printer comprising; a cassette receiving bay configured to receive a cassette, a print head arranged in the cassette receiving bay; a platen arranged in the cassette receiving bay; wherein said cassette receiving bay has a base surface and at least one side, wherein of said sides is provided with a switch, the position of which is controlled by a cassette, when in the cassette receiving bay.

According to an eighth aspect, there is provided a label printer comprising; a cassette receiving bay configured to receive a cassette, a print head arranged in the cassette receiving bay; a platen arranged in the cassette receiving bay; wherein said cassette receiving bay has a base surface the label printer is further provided with a plurality of support surfaces which are spaced apart from said base and which are configured to support a cassette, when in the cassette receiving bay.

BRIEF DESCRIPTION OF THE SEVERAL VIEWS OF THE DRAWING

Some embodiments of the disclosure will now be described, by way of example only, with reference to the accompanying drawings in which:

FIG. 1 shows a first perspective view of a cassette according to one embodiment of the present invention, showing a first side of the cassette;

FIG. 2 is a perspective view of the cassette of FIG. 1, showing the side opposite to that shown in FIG. 1;

FIG. 3 is a view of a second surface of the cassette of FIG. 1, not shown in FIG. 1 or 2;

DETAILED DESCRIPTION OF THE PREFERRED EMBODIMENTS

Figures 4A, 4B:
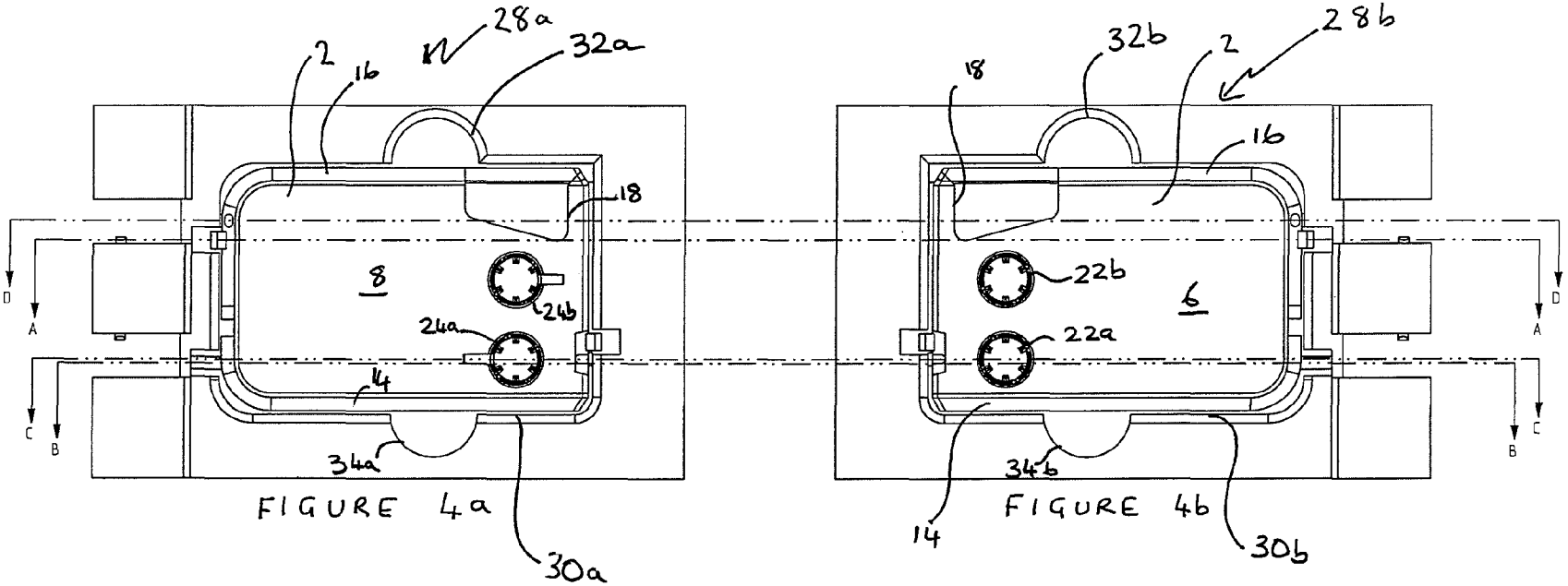
FIG. 4*a* shows the cassette of FIG. 1 inserted in a first label printer.
FIG. 4*b* shows the cassette of FIG. 1 inserted in a second label printer.

In the Figures, like reference numerals indicate like parts.

The cassette shown in the Figures is arranged to house one or more supplies of print medium. The print medium may be an ink ribbon and/or may be an image receiving medium. An image receiving medium may be in the form of an image receiving tape having an upper image receiving layer for receiving an image and a removable backing layer secured to the upper image receiving layer by a layer of adhesive such that after an image has been printed, the backing layer can be removed and the image receiving layer can be stuck to a surface. This image receiving tape may be a continuous supply. Accordingly, the cassette may be used with a label printer which includes a cutter for cutting off a length of image receiving tape after the image has been printed.

Alternatively, the image receiving medium may comprise a continuous backing layer whilst an image receiving layer is in the form of pre-cut labels. In this example, the label can be printed and then peeled off from the backing layer. Alternatively, the labels may be connected together with no backing layer. The labels may be separated by lines indicating where a user should cut or lines of weakness such as perforations.

As mentioned, the cassette may hold an image receiving medium or an ink ribbon. In some embodiments, the cassette may house an image receiving medium and an ink ribbon.

Some cassettes may be used with a thermal label printer where an image is generated by the activation of a thermal printhead against the ink ribbon such that ink from the ink ribbon is transferred onto the image receiving medium at a print zone.

It should be appreciated that in some embodiments of the present disclosure, where the cassette just houses an image receiving medium, that image receiving medium may be in the form of a direct thermal image receiving medium. A direct thermal image receiving medium is such that an image can be created directly onto or within the direct thermal image receiving medium by a thermal printhead, without the requirement of an ink ribbon.

It should be appreciated that in an alternative embodiment, the cassette may only house an image receiving medium. An ink ribbon may be housed in a separate cassette.

Alternative embodiments of the invention may have different image receiving medium structures. For example a protective layer may in some embodiments be applied to the printed surface after printing. In other embodiments of the invention, a protective layer may be provided on the image receiving surface and printing occurs through the protective layer. In yet another embodiment, an image is applied to a surface of an image receiving medium and then the image receiving medium is adhered to the backing layer, with the printed image being on the side of the image receiving medium being adhered to the backing layer. In some embodiments, there may be not backing layer. These embodiments may have a layer of adhesive. In alternative embodiments, there may not be any adhesive. These are just some examples of the possible structure of the image receiving medium and other structures are of course possible.

In some embodiments of the disclosure, a particular label printer may be arranged to receive a range of different cassettes housing different image receiving mediums and/or ink ribbons. The printing media may different in type and/or width. The cassettes may differ in their thickness depending on the size of the printing media accommodated therein.

Mention has been made of the use of a thermal print head. It should be appreciated that alternative embodiments may used different printing technologies such as ink jet or any other suitable printing technique.

Some cassettes embodying the present invention will now be described with reference to the accompanying Figures. The cassette 2 has a housing 4. The housing 4 has a generally rectangular cuboid shape and thus is generally box like. The housing 4 has a first surface 6 and a second surface 8. The first and second surfaces 6 and 8 are the larger surfaces of the housing 4 and are arranged opposite one another. As will be described in more detail later, one of these first and second surfaces 6 and 8 is arranged to face and/or be in contact with a corresponding surface of a cassette receiving bay in a label printer. This will depend on the configuration of the respective cassette receiving bay.

The housing 4 also has a first side 10, a second side 12, a third side 14 and a fourth side 16. These sides each extend between the first and second surfaces 6 and 8. The first side 10 is opposite the second side 12. The third side 14 is opposite the fourth side 16.

The housing 4 has a print area 18 which in use is arranged to accommodate at least part of the printing mechanism of the label printer (as will be described later in relation to FIG. 10). The print area 18 extends from the fourth side 16 into the cassette 2. The print area 18 is open at both the first and second surfaces 6 and 8 to provide an accessible print area. This means that the cassette can be inserted into the respective cassette receiving bay with either of the first and second surfaces facing the bottom surface. The surface which faces the bottom of the cassette receiving bay will depend on the configuration of cassette receiving bay of the label printer.

In one embodiment of the present disclosure, a cover 20 is provided on the fourth side 16. The moveable cover 20 is moveable along the plane of the fourth side 16 from a position in which the print area 18 is closed off in the plane of the fourth side (as can be seen in FIG. 3) and a position in which the print area 18 is open in the plane of the fourth side 18. In an alternative embodiment of the invention, the cover 20 may be omitted.

Figure 9:
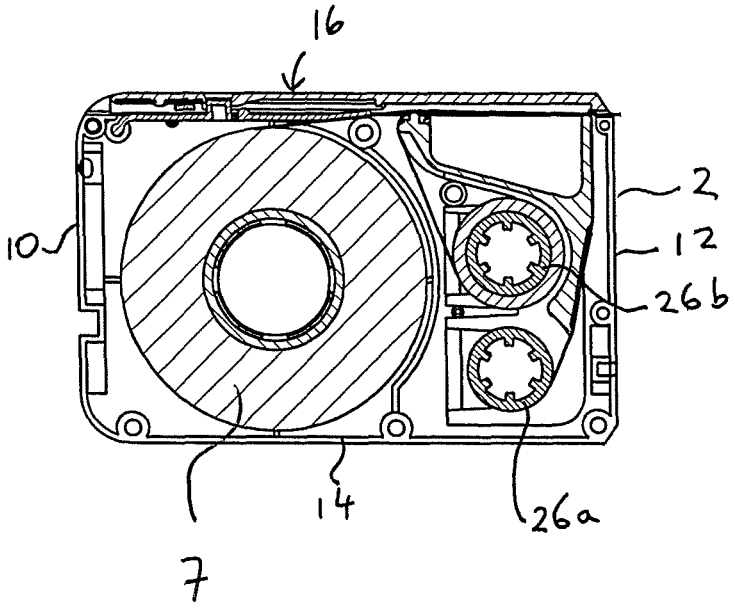
FIG. 9 shows the interior of the cassette of FIG. 1.

The cassette has first and second openings 22*a* and 22*b* provided on the first surface 6. Directly opposing these openings are openings 24*a* and 24*b* provided on the second surface. The first opening 22*a* of the first surface is aligned with the first opening 24*a* of the second surface. Likewise, the second opening 22*b* of the first surface is aligned with the second opening 24*b* of the second surface. A first ink ribbon spool 26*a* (see FIG. 9) extends between the openings 22*a* and 24*a*. Likewise, a second ink ribbon spool 26*b* (see FIG. 9) extends between the two second openings 22*b* and 24*b*. One of these ink ribbon spools is an ink ribbon supply spool and the other of the ink ribbon spools is an ink ribbon take up spool. In the example shown, the second ink ribbon spool 26*b* is the supply spool and the first ink ribbon spool 26*a* is the take up spool.

Figures 17A, 17B:
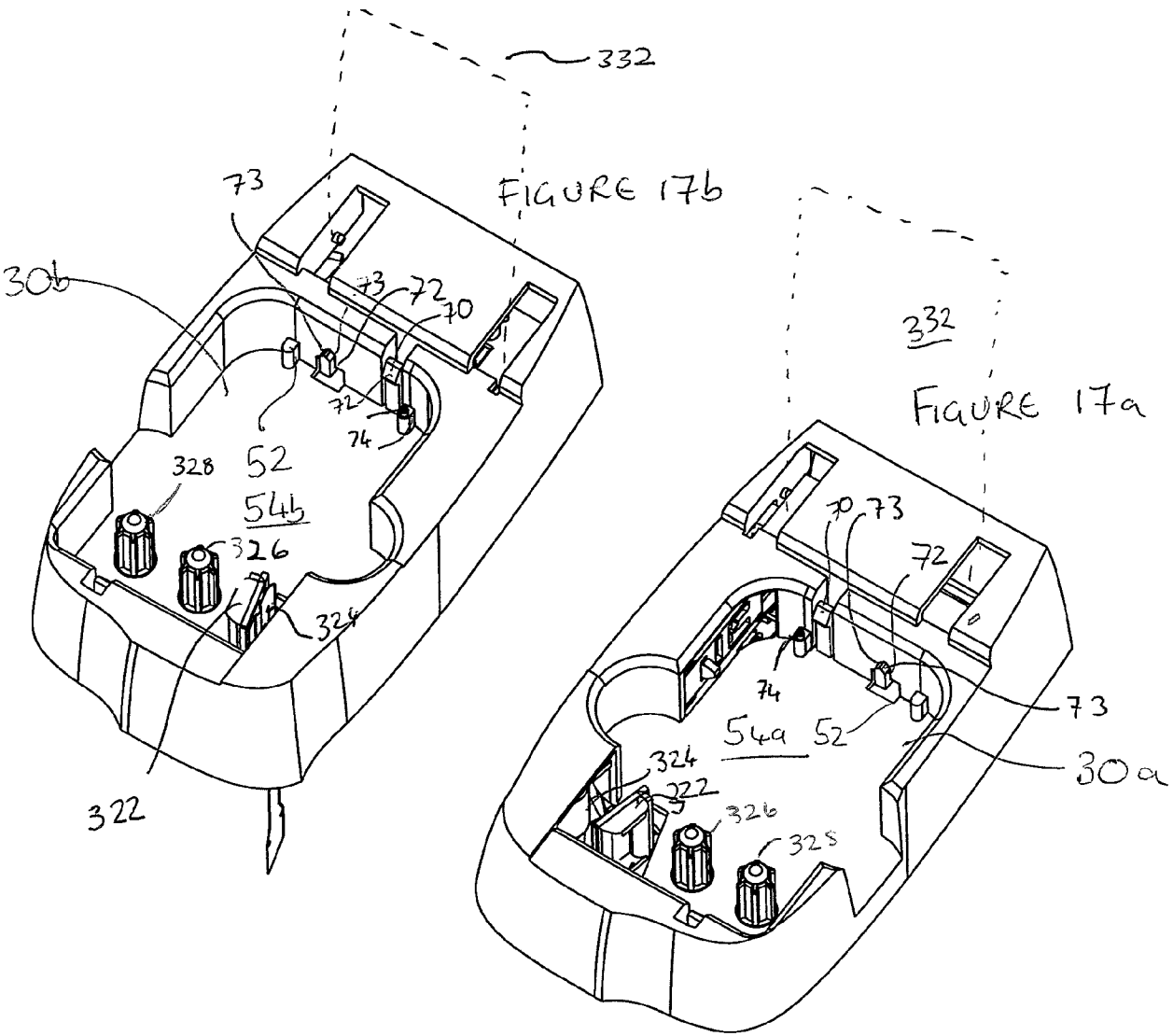
FIGS. 17*a* and 17*b* respectively show the cassette receiving bays of the label printers of FIGS. 4*a* and 4*b*, with no cassette present.

As can be seen from FIGS. 17*a* and *b*, the cassette receiving bay comprises first and second ink ribbon posts 326 and 328 which are arranged to be received in and engage with respective ones of the ink ribbon supply and take up spools. At least one of the ink ribbon posts can be driven in a forwards and/or reverse direction. The cassette receiving bay will be described further later.

Figure 11A:
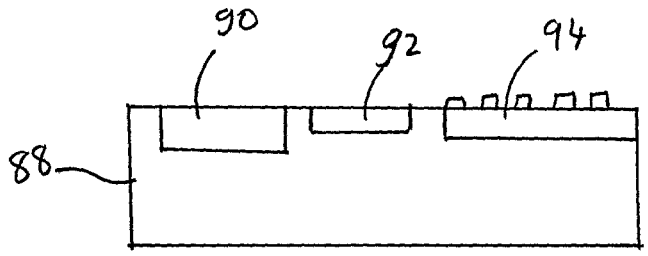
FIG. 11*a* shows a schematic view of a first label printer.

The cassette shown in the Figures can be used with a range of different label printers which have different designs. For example, reference is now made to FIGS. 11*a* and 11*b*. FIG. 11*a* shows a first label printer 88. On the same surface of the label printer is provided a cassette receiving bay 90, a display 92 and a keyboard 94. As can be seen from FIG. 11*a*, the cassette receiving bay 90, display 92 and keyboard 94 are all on the same surface of the label printer 88.

Figure 11B:
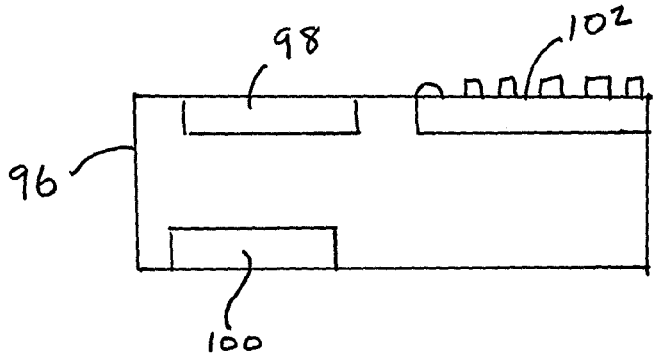
FIG. 11*b* shows a schematic view of a second label printer.

In contrast, a second label printer 96 is shown in FIG. 11*b*. The display 98 and the keyboard 102 are provided on a first side of the label printer whilst the cassette bay 100 is provided on the opposite side of the label printer.

It should be appreciated that in other embodiments of the present invention, no keyboard is provided and the label printer is instead connected to a PC which provides label data to be printed on the labels. Of course label printers such as shown in FIGS. 11*a* and 11*b* may operate in a stand-alone mode and/or in PC connected mode where the PC provides the label data to be printed on the labels.

In one modification, the display and keyboard may be replaced by a touch screen providing both functionalities.

By way of example only, reference is made to FIGS. 4*a* and 4*b*. In FIG. 4*a*, the cassette 2 is inserted in a first label printer 28*a*. When the cassette 2 is inserted in the first label printer 28*a*, the first surface 6 will face the bottom 54*a* of the cassette receiving bay 30*a* with the second surface 8 uppermost. FIG. 17*a* shows a perspective view of the cassette receiving bay without the cassette.

This contrasts with the second label printer 28*b* shown in FIG. 4*b*. With the second label printer 28*b*, the cassette 2 is inserted into the cassette receiving bay 30*b* the other way round such that the second surface 8 faces the bottom 54*b* of the cassette receiving bay 30 and the first surface 6 is uppermost. FIG. 17*b* shows a perspective view of the cassette receiving bay without the cassette The cassette receiving bays of FIGS. 4*a* and 4*b* may be respectively provided on opposite sides of respective tape printers, such as shown in FIGS. 11*a* and 11*b*. Alternatively, the cassette receiving bays of FIGS. 4*a* and 4*b* may be provided on the same sides of respective tape printers. In either case, the cassette receiving bays of FIGS. 4*a* and 4*b* are mirror images of each other.

A cassette which can be inserted in a cassette receiving bay with the first surface 6 facing the bottom 54*a* of the cassette receiving bay 30*a*, and which can also be inserted in a second mirrored cassette receiving bay 30*b* with the second surface 8 facing the bottom 54*b* of the cassette receiving bay 30*b* may have the advantage that the position of the tape exit is no longer determined by the position of the cassette receiving bay in the printer. For example, if a cassette can be inserted in only one direction, a label printer with a cassette receiving bay open at the front will not have the same tape exit location as a label printer with a cassette receiving bay open at the back of the label printer (for the same cassette). With a cassette for which the first surface 6 as well as the second surface 8 can face the bottom of the cassette receiving bay, this is no longer the case.

Thus as can be seen from a comparison of FIGS. 5*a* to 8*a* with FIGS. 5*b* to 8*b*, the cassette can be used in an orientation where the first surface 6 faces the cassette receiving bay or where the second surface 8 faces the bottom of the cassette receiving bay. If the first surface 6 is arranged to face the bottom of the first cassette receiving bay then the second cassette receiving bay which is arranged to accommodate a cassette where the second surface faces the bottom of the second cassette receiving bay, that second cassette receiving bay mirrors the first cassette receiving bay.

In the label printer 28*a* shown in FIG. 4*a*, a first area 32*a* and a second area 34*a* are provided opposite one another and on either side of the cassette 2. In the embodiment of FIG. 4*a*, the first area 32*a* is adjacent to the fourth side 16 of the cassette whilst the second area 34*a* is adjacent to the third side 14 of the cassette. The first and second area 32*a* and 34*a* are sized so as to accommodate on one side a user's thumb and on the other side the user's forefinger. In this way, the user can grip the third and fourth sides 14 and 16 of the cassette to remove the cassette from the cassette receiving bay. It should be appreciated that this is by way of example only and various other mechanisms for removing a cassette from the cassette receiving bay can be used including various types of ejection mechanism.

The second label printer 28*b* is provided with similar first and second areas 32*b* and 34*b* respectively for allowing the cassette to be removed from the cassette receiving bay.

Figure 18A:
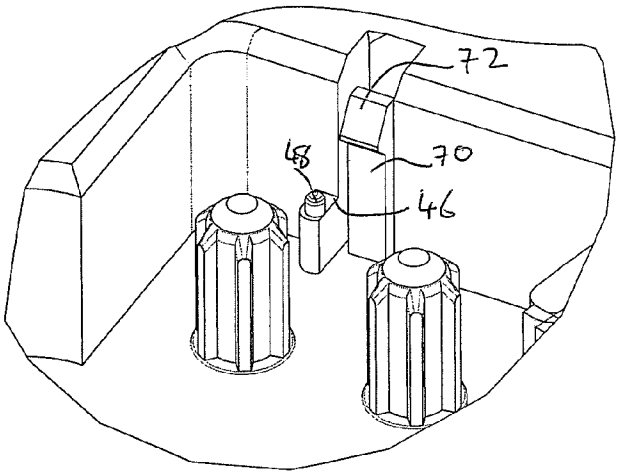
FIGS. 18*a* and 18*b* show part of a wall of the cassette receiving bays of the label printers of FIGS. 4*a* and 4*b*, opposite to the wall shown in FIGS. 17*a* and *b;*
Figure 18B:
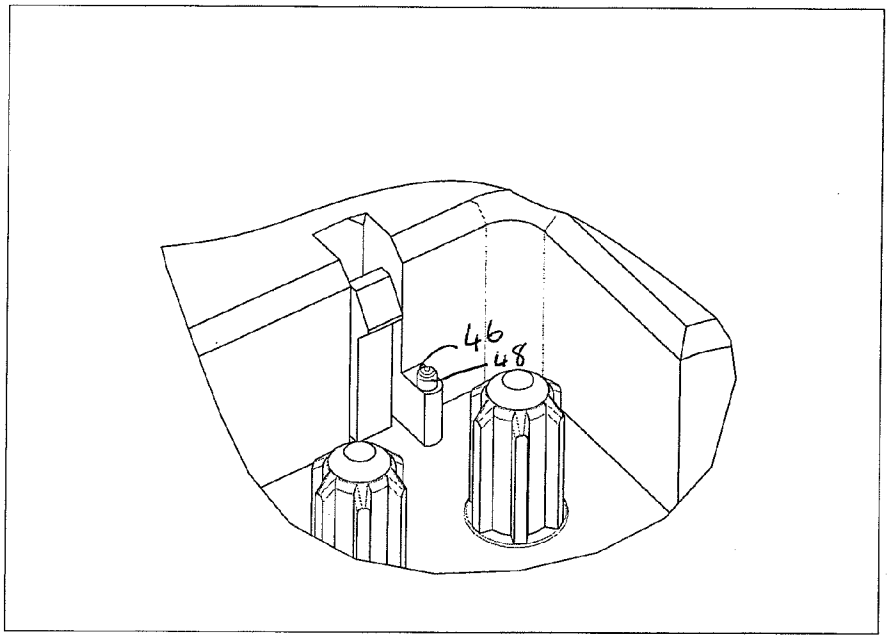

The various features of the cassette which allow the cassette to be positioned in the cassette receiving bay 30*a* or 30*b* will now be described with particular reference to FIGS. 5 to 8 as well as FIGS. 17 and 18. It should be appreciated that FIGS. 5 to 8 show cross-sections through the label printers of FIGS. 4*a* and 4*b*. However, to show clearly the interaction between parts of the cassette and the cassette receiving bay, the cassette is not shown in cross-section and instead the outline of the cassette on the respective cross-section is shown.

Reference is made to FIG. 2 which shows on the second side 12 a first positioning arrangement 36. The first positioning arrangement 36 is symmetrical about a line extending along the middle of the second side 12, parallel to the first and second surfaces 6 and 8 and halfway between the first and second surfaces 6 and 8. On each side of the middle line is a first larger indented area 40 which extends from the respective one of the first and second surfaces towards the middle line. The first indented area 40 has a planar surface 42 which is parallel to the respective first and second surfaces 6 and 8. That planar surface 42 in turn has its own second smaller indented area 44 which again extends towards the middle line.

The smaller indented area 44 does not extend across the middle line. Thus, the positioning arrangement 36 comprises two symmetrical parts, each part being arranged on either side of the middle line and each comprising the first and second indented areas.

The interaction of this first positioning arrangement with the cassette receiving bay of the label printers will be described with reference to FIGS. 7 and 8.

Figures 5A, 5B, 6A, 6B, 7A, 7B, 8A, 8B:
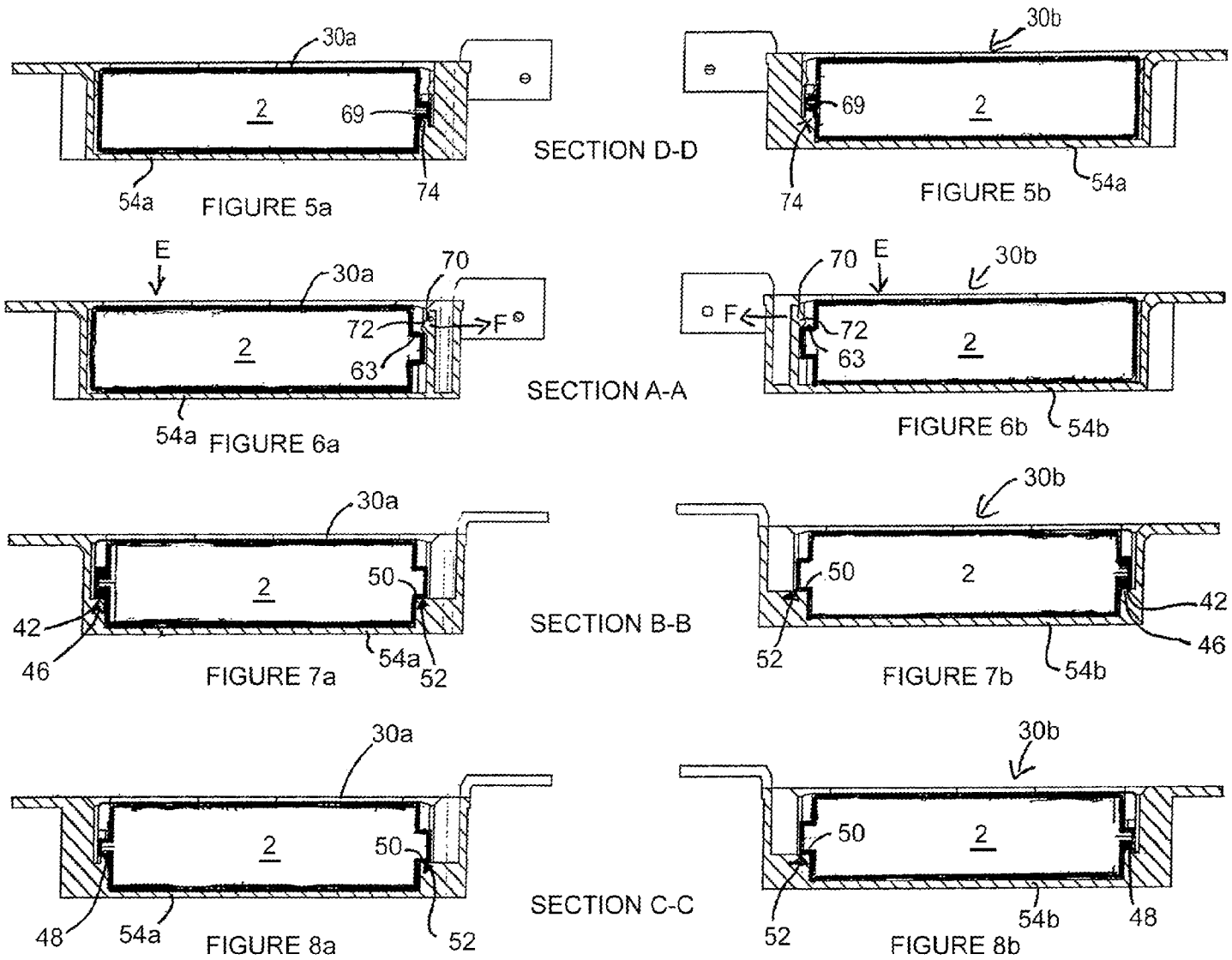
FIG. 5*a* is a section along line D-D of FIG. 4*a;*
FIG. 5*b* is a section along line D-D of FIG. 4*b;*
FIG. 6*a* is a section along line A-A of FIG. 4*a;*
FIG. 6*b* is a section along line A-A of FIG. 4*b;*
FIG. 7*a* is a section along line B-B of FIG. 4*a;*
FIG. 7*b* is a section along line B-B of FIG. 4*b;*
FIG. 8*a* is a section along line C-C of FIG. 4*a;*
FIG. 8*b* is a section along line C-C of FIG. 4*b;*

FIGS. 8*a* and 8*b* show a cross-section of the cassette receiving bay, with the cassette shown in outline and the cross-section taken through the second indented area 44. In contrast, FIGS. 7*a* and 7*b* show a cross-section which is taken through the first positioning arrangement 36, through the first indented area 42, but not through the second indented area 44. As shown in FIGS. 7*a* and 7*b*, the planar surface 42 of the first indented area 40 lies in contact with surface 46 of the cassette receiving bay to keep the cassette in position. The surface 46 is parallel to the bottom 54*a/b* of the cassette receiving bay. These elements of the cassette receiving bay can also be seen clearly from the FIGS. 18*a* and *b*.

As can be seen from FIGS. 8*a* and 8*b*, a pin 48 of the cassette receiving bay is received in the further indentation 44 of the first positioning arrangement. In an alternative embodiment the pin may be provided by a base plate underlying the cassette receiving bay. The pin 48 is sized such that the pin 48 can be received in the further indentation 44 with only a small amount of play in a first direction and a larger amount of play in a second direction. The pin 48 extends generally from the surface 46 and has a height which is slightly smaller than the size of the second indentation 44. This is to accommodate manufacturing tolerances associated with the cassettes Reference is now made to FIG. 1 which shows a second positioning arrangement 38 on the first side 10 of the cassette. The second positioning arrangement 38 is again symmetrically arranged around a middle line which extends along the length of the first side 10, parallel to the first and second surfaces 6 and 8. The second positioning arrangement 38 comprises a step 39 on either side of the middle line. The step 39 starts on the first side 10, from the respective surface 6 and 8 and at a location on the first side adjacent the third side. The step 39 and extends towards the middle line, then has a planar surface 50 which extends parallel to the first and second surfaces 6 and 8 and then a surface 51 which extends at right angles to the planar surface 50 to the middle line.

The interaction with the second positioning arrangement 38 with the respective cassette receiving bays can be seen from FIGS. 7 and 8 as well as FIGS. 17*a* and *b*. In particular, the step 39 which is closer to the surface 6 or 8 of the cassette which faces the bottom of the cassette receiving bay is arranged to interact with a surface 52 of the cassette receiving bay. In particular, planar surface 50 is arranged to contact surface 52 of the cassette receiving bay. Surface 52 is parallel to the surface 54 at the bottom of the cassette receiving bay. Surface 52 is also parallel to surface 46. In one embodiment of the present invention, surfaces 52 and 46 are contained in the same plane. However, in alternative embodiments, surfaces 52 and 46 may be contained in different planes.

Reference is again made to FIG. 1. On the first side 10 is a switch operating arrangement 60. Again, the switch operating arrangement 60 is symmetrical about the middle line. The symmetrical switch operating arrangement 60 comprises a step 62 on either side of the middle line. The step 62 is bigger than the corresponding step 39 of the second positioning arrangement 38. The step 62 is arranged in one embodiment to extend over more than half the length of the first side 10. The step 62, on each side of the middle line starts at a location on the first side adjacent the fourth side 16. The step 62 then extends towards the middle line. There is then a planar surface 63 which extends parallel to the first and second surfaces. At the end of the planar surface 63 is a ramp 64 which extends from the end of the planar surface 63 to the middle line. The ramps are each contained in a plane, the plane of which is generally at right angles to the plane of the first side. The two ramps 64 of each step 62 are arranged to meet at the middle line to define a V-shaped area at the ends of the steps 62. In the embodiment shown, there is a gap or space 66 between the end of the ramps 64 and the surfaces 51 of the second positioning arrangement 38. In an alternative embodiment there are two indented areas between the end of the ramps 64 and the surfaces 51 of the second positioning arrangement 38. The two indented areas are in that case symmetrical on either side of the middle line.

Each step 62 is provided with a positioning hole 69 extending into the planar surface 63 towards the middle line. The positioning hole may be provided on the planar surface 63 at an end region thereof which is closer to the fourth side 16 than to the ramp end of the planar surface 63. This positioning of the positioning hole 69 achieves that the first side comprises at one end the second positioning arrangement and at the other end a third positioning arrangement (i.e. the arrangement of hole 69, and the correspondent hole on the other side), which in combination with the first positioning arrangement 36 ensures three positioning arrangements for the cassette in the cassette receiving bay. The three positioning arrangements together ensure a correct positioning of the cassette in the cassette receiving bay.

In one embodiment the three positioning arrangements are provided as a plane is defined by at least three points. Accordingly in one embodiment, there are three positioning arrangements to ensure that the cassette is positioned in a plane. Thus in some embodiments, the three positioning arrangements ensure that the cassette rests in the correct plane. The two positioning pins ensure that the cassette does not move in the two directions of the plane, and the locking members ensure that the cassette does not move in the third direction.

Figure 12:
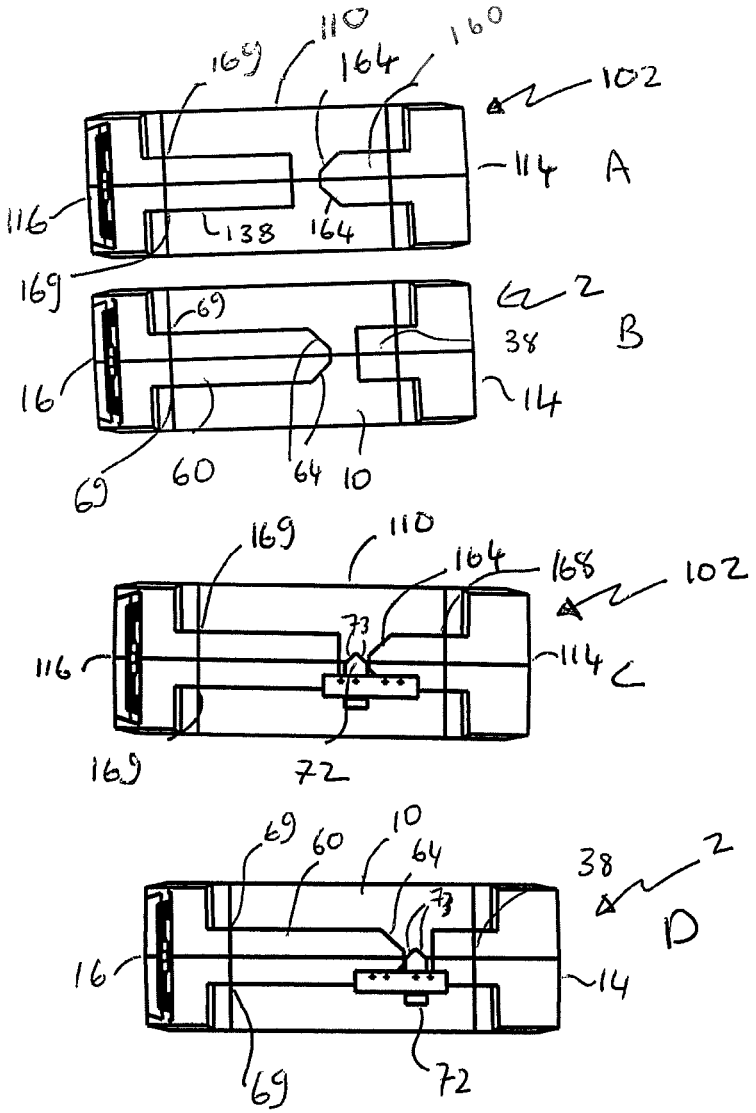
FIG. 12*a* shows a second cassette embodying the invention
FIG. 12*b* shows the cassette of FIG. 1 for comparison.
FIG. 12*c* shows the second cassette with respect to a ramp switch of the label printer.
FIG. 12*d* shows the cassette of FIG. 1 with respect to the ramp switch of the label printer.

In one embodiment of the present disclosure, a set of cassettes is provided. In this embodiment, two cassettes are provided in the set. It should be appreciated that other embodiments may have different numbers of cassettes in the set. The set comprises the cassette as already described as well as the second cassette shown in FIG. 12*a*. For comparison, the second cassette of FIG. 12*a* is shown next to the first cassette in FIG. 12*b*. The cassettes of the set may be of the same general arrangement but have different first sides. FIGS. 12*a* and *b* shows the different configuration of the first side of the second cassette 102.

In the second cassette 102 shown in FIG. 12*a*, the first side 110 comprises a second positioning arrangement 138. The second positioning arrangement 138 is similar to the second positioning arrangement 38 shown in FIG. 1 but is instead positioned on the first side 110 adjacent the fourth side 116 of the cassette. Furthermore this second positioning arrangement 138 is also arranged to have respective positioning holes 169, provided opposite one another on each side of the second positioning arrangement 138. The positioning holes have the same function and location as the positioning holes 69 of the switching arrangement 60 of FIG. 1. It should be appreciated that in the embodiment shown, the length of the second positioning arrangement corresponds generally to the length of the switch operating arrangement 60 of the cassette of FIG. 1, excluding the ramps 64.

The first side 210 of the second cassette 102 comprises a switch operating arrangement 160 which is again similar to the switch operating arrangement 60 of the cassette of FIG. 1.

However, the switch operating arrangement 160 of the second cassette 102 is arranged adjacent the third side 114. The length of the switch operating arrangement 160 excluding the ramps 164 is thus generally the same as the length of the second positioning arrangement of the first cassette. The ramps 164 then extend in the same manner as described in relation to the first cassette. The switch operating arrangement of the second cassette is thus generally a mirror image of the switch operating arrangement of the first cassette. The switch operating arrangement 160 does not have the positioning holes as these are now provided by the second positioning arrangement as described previously.

The set of cassettes may be arranged to have a third cassette which does not have the switch operating arrangement but instead effectively has two second positioning arrangements. Thus no ramps are provided.

In alternative embodiments of the present disclosure, the set of cassettes may comprise three or more different cassettes.

The cassettes of the set may be arranged to house different types of image receiving medium. By way of example only, the first cassette may house image receiving medium of a first width and the second cassette may house image receiving medium of a second width. In one embodiment the first cassettes may house one of a first subset of widths and/or the second cassette may house one of a second subset of widths. Where a third cassette is provided this may house a third width or one of a third subset of widths. It should be appreciated that if the cassettes of the set are arranged to house different widths of tape, the width of the cassette (i.e the distance between the first and second surfaces) may be different for different ones of the cassettes of the set.

The position of the ramp (and hence its interaction with a switch in the label printer) may be used to convey information about the printing medium of the cassette (the image receiving medium and/or ink ribbon). That information may be width and/or print energy requirements; colour of printing medium; thickness of printing medium; type of printing medium or the like.

Figure 19A:
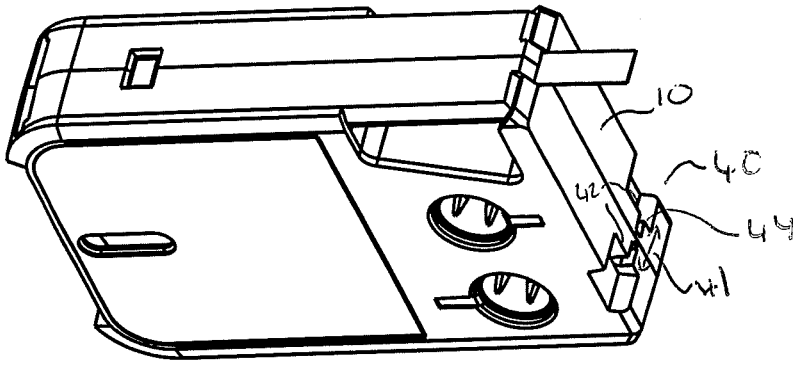
FIGS. 19*a* and 19*b* show two cassettes embodying the invention with the cassette of FIG. 19*b* being wider than the cassette of FIG. 19*a*, for comparison.
Figure 19B:
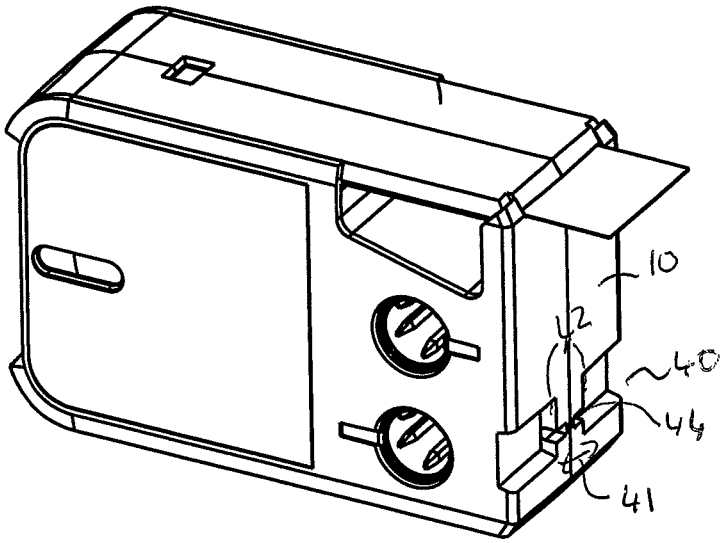

Reference is made to FIGS. 19*a* and 19*b* which show for comparison purposes a wider cassette in FIG. 19*b* and a narrower cassette in FIG. 19*a*. These cassettes may house different widths of cassette. As can be seen the first positioning arrangement 40 of each cassette is arranged, centred along the middle line of the first side 10. Further the distance 41 between the planar surfaces 42 of the two indented areas is the same for both cassettes. Further the second indented areas 44 are the same for each of the cassettes. Thus, the cassettes are configured to have a central alignment when mounted in the cassette receiving bay. This means that the centre plane between the two surfaces of all the different sizes of cassettes will always be in the same plane. Thus the same dimensioned first positioning arrangement, centred about the centre plane, will be used regardless of the width of the cassette. The other positioning arrangements may also have the same dimensions regardless of the width of the cassette.

Figure 13:
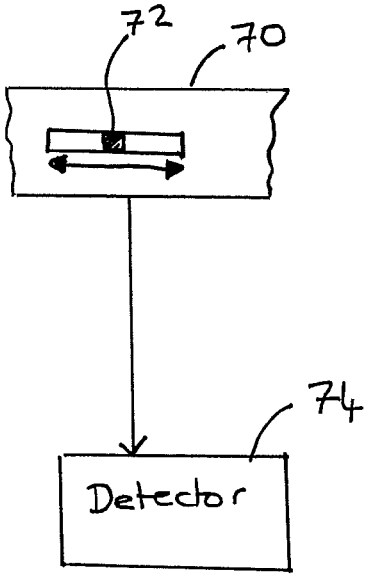
FIG. 13 shows schematically part of wall of a cassette receiving bay.

Reference is now made to FIG. 13 which schematically shows part of the label printer and in particular part of the cassette receiving bay wall 70 which in use faces the first wall 10 or 110 of the cassette when inserted in the cassette receiving bay. The cassette receiving bay wall 70 comprises a switch 72. In one embodiment, the switch is biased to a neutral position, in FIG. 13. This neutral position is a central position. Thus in one embodiment, when there is no cassette in the cassette receiving bay, the switch will be in the neutral position.

When the first cassette is received in the cassette receiving bay, the switch 72 is moved by the ramp 64 to the right of FIG. 13. This also can be seen from FIGS. 17*a* and 17*b*. The switch 72 itself has first and second ramped surfaces 73 which are arranged to engage the respective ramp of the switching operating arrangement 160. This is also shown schematically in FIG. 12*d* which shows the switch 72 which has been moved by the ramp 64 to a position where the switch is accommodated between the switch operating arrangement 60 and the second positioning arrangement 38. In an alternative embodiment, the switch 72 has no ramped surfaces but a flat, rounded or any other type of surface.

When the second cassette is received in the cassette receiving bay the switch 72 is moved by the ramp 164 to the left of FIG. 13. Again, this also can be seen from FIGS. 17*a* and 17*b*. This is also shown schematically in FIG. 12*c* which shows the switch 72 which has been moved by the ramp 164 to a position where the switch is accommodated between the switch operating arrangement 160 and the second positioning arrangement 138. As can be seen from a comparison of FIGS. 12*c* and *d*, the switch 72 is moved to one position by the first cassette and to a second, different position by the second cassette.

A detector 74 is arranged to determine which position the switch 72 is in, that is the left position or the right position. The detector 72 is thus able to provide an output to the controller which indicates if the cassette is the first cassette or the second cassette. This provides information to the controller about one or more properties of the printing medium in the cassette. For example if a first cassette is detected, the controller is configured to control the label printer in accordance with the width associated with the first cassette. Likewise if a second cassette is detected, the controller is configured to control the label printer in accordance with the width associated with the second cassette. For example this information may be used by the label printer to control the size of the image so that the resulting image can be printed on the image receiving medium.

In some embodiments, the cassette may not be designed to be inserted in two different directions. In those embodiments, only one half of the arrangements shown of sides 10 or 110 are provided. For example the ramp on the side of the middle line which is opposite the positioning hole 69 which engages the printer may be omitted.

Reference is now made to FIGS. 5 and 6 which respectively show cross-sections along lines D-D and -AA. In particular, reference is made to FIG. 6 which shows a locking member 70 of the cassette receiving bay. The locking member 70 is made of a resilient material. Accordingly, in order to insert the cassette into the cassette receiving bay in the direction of arrow E, the locking member 70 moves in the direction of arrow F away from the cassette so as to allow the steps 62 to pass a projecting part 72 of the locking member. The projecting part 72 is such that when the cassette is received completely in the cassette receiving bay, the projecting part 72 engages the planar surface 63 of the step which is further from the bottom of the cassette receiving bay. It should be noted that a similar locking member 70 (see FIGS. 18*a* and 18*b*) are provided adjacent surface 46 and pin 48 on the other side of the cassette receiving bay.

As can be seen in FIG. 5, a pin 74 of the cassette receiving bay is arranged to be received in the positioning hole 69 of the step closer to the bottom of the cassette receiving bay. This pin is sized so as to generally correspond to the size of the positioning hole, but allowing for manufacturing tolerances associated with the cassette. It should be appreciated that the positioning hole may be circular in cross section or have any other suitable shape. The pin preferably, but not necessarily has a cross-section which is the same shape as the cross-section of the positioning hole.

The positioning and locking arrangements shown are such that one or more of the arrangements may be omitted and/or replaced by a different arrangement. The positioning arrangements may be the same or different. The switching arrangement may be omitted in some embodiments of the invention. The second positioning arrangement may be arranged on the first side adjacent the fourth side. In an alternative embodiment of the invention any one of the described arrangements may be provided on any one of the sides of the cassette.

It should of course be appreciated that in alternative embodiments, alternative mechanisms can be used to position and retain the cassette in the cassette receiving bay.

Figure 14:
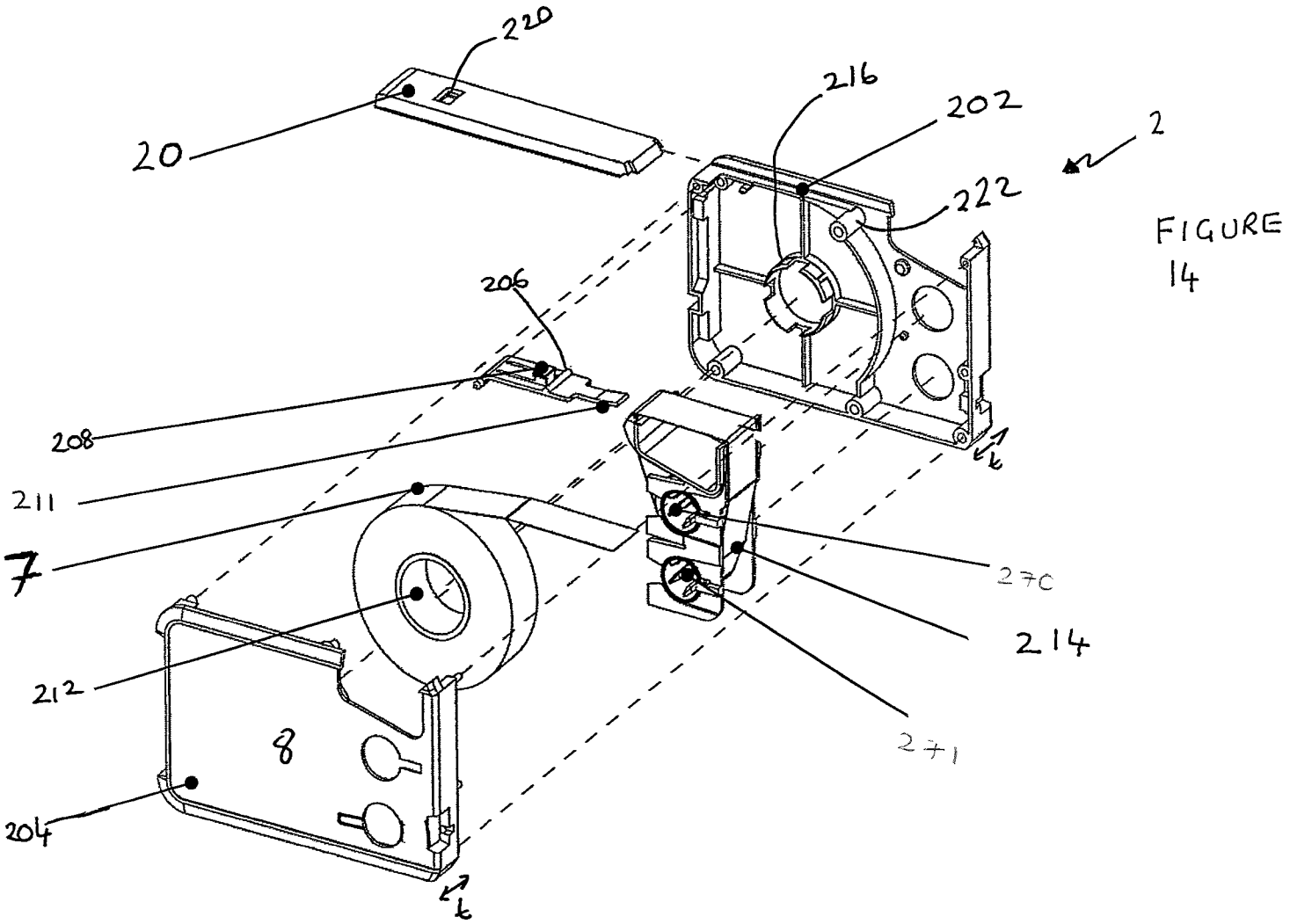
FIG. 14 shows an exploded view of the cassette of FIG. 1.

Reference is now made to FIG. 14 which shows an exploded view of a cassette embodying the present invention. The cassette 2 comprises a first part 202 and a second part 204. The first part 202 and the second 204 define the housing 4 of the cassette. In one embodiment of the present invention, the first and second parts, externally, are arranged to be mirror images one of the other. This means that making the moulds of the cassette can be more cheaply done. Internally, the first and second parts are similar but not the same. This is because the two parts are arranged to be fitted together with, for example, press fittings, snap locks or the like. Accordingly, the first and second parts are formed with cooperating members to ensure that the two parts can be locked together.

The two parts 202 and 204 are arranged to have the same thickness t. This thickness is in the direction perpendicular to the respective surfaces 6 and 8. In other words, the width of each of the sides of the cassette, defined by the two parts, is equal to 2t. This is in contrast with known cassettes which generally have one part which provides most of the width of the cassette whilst the other part provides a lid and contributes a smaller amount of the thickness or width of the cassette. Having the two parts which have the same thickness is advantageous if, for example providing a cassette which can be inserted either way round into cassette receiving bays.

The cassette is arranged to house the supply of image receiving medium 7. As can be seen, the image receiving medium is provided on a spool 212. The spool 212 is arranged to spool engagement members 216 provided in the first half 202. Similar spool engagement members may be provided in the other half 204. These spool engagement members 216 are arranged to fit inside the spool 212 to position the spool 212 in the cassette. The spool engagement members 216 are positioned such that the image receiving medium spool is held in place but the spool is arranged to rotate about the spool engagement members 216.

The cassette is also provided with the cover 20. This cover 20 is arranged to move from a first position, which is shown for example in FIG. 3 in which the image receiving medium and the ink ribbon is protected by the cover 28 in the print area. In a second open position, the cover 20 is moved such that the image receiving medium and ink ribbon are exposed in the print area 16.

A clamping/locking member 206 is provided. The clamping/locking member 206 has a first locking projection 208 which is arranged to engage an opening 220 of the cover 20 to hold the cover in the closed position. The member 206 has a clamp end 211 which is arranged to interact against a post 222 of one or both of the parts 202 and 204 to clamp the image receiving medium there between. This clamping may occur when the cover is the closed position. Movement of the cover from the closed to open position may cause the clamping force provided by the clamp 211 to be reduced such that the image receiving medium can be drawn from the supply. The clamping force in some embodiments may only be removed when the cover is in the fully open position.

Figure 15:
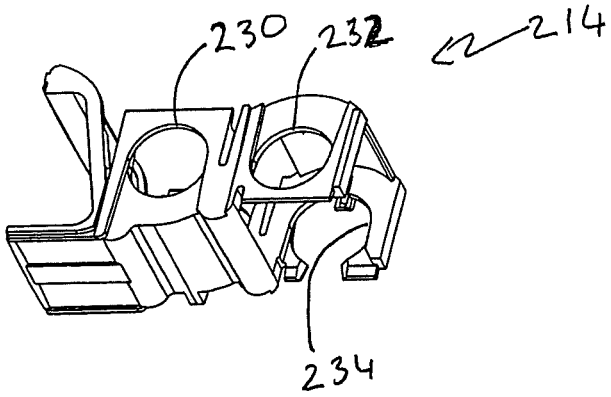
FIG. 15 shows the ink ribbon subassembly of FIG. 14.
Figure 16:
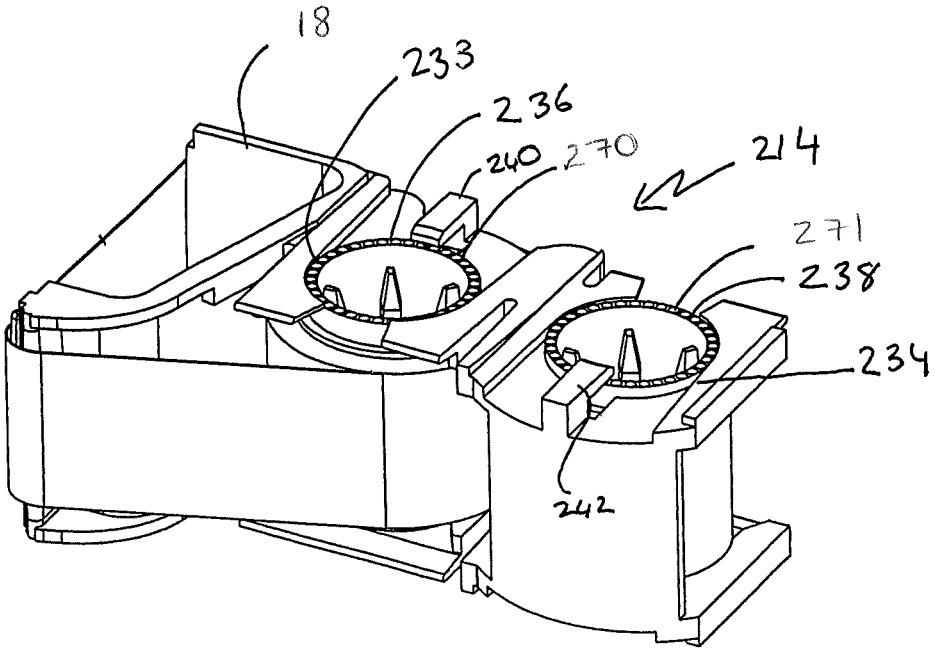
FIG. 16 shows the ink ribbon subassembly of FIG. 15 with the ink ribbon supply spool and take up in place.

The cassette also has an ink ribbon subassembly 214. This subassembly can be seen more clearly from FIGS. 15 and 16. FIG. 15 shows the subassembly 214 without the ink ribbon take-up spools and supply spools present. FIG. 16 shows the subassembly with the ink ribbon take-up spools 271 and supply spools present 270. It should be noted that FIG. 15 shows the subassembly from one side whilst FIG. 16 shows the subassembly from the opposite side. The subassembly 214 has a first circular opening 230 and a second circular opening 232 on one side. These two openings are arranged to receive respective ends of the ink ribbon take-up 271 and supply spools 270. On the opposite side of the ink ribbon subassembly 214, first and second collars 233 and 234 are provided. The collars each generally define part of the circle. The collars are of such a size and shape that the respective upper regions 236 and 238 of the ink ribbon supply 270 and take-up spool 271 can be pushed in position into the collar. The collars do not form a complete enclosed circle which allows the spools to be laterally inserted into the ink ribbon subassembly. The two spools are laterally inserted from opposite sides. The size of the collars may be such that the spools need to be pressed in to be accommodated in the collars. In one embodiment, the collars are of a sufficiency flexible material such that the spools could be pushed into the collars but then subsequently retained in position by those collars.

The ink ribbon subassembly 214 has first and second locking members 240 and 242. The locking members are arranged each to engage a respective one of the ink ribbon spools. These locking members 240 and 242 engage the ink ribbon spools to prevent the ink ribbon from being withdrawn of the respective spools unless sufficient force is provided by for example the driving of one or more of the take up and supply spools 271 and 270. The respective locking members may be accommodated in cut out portions 221 of the lower surface 8 (see FIG. 3). These locking members 240 and 242 are provided on opposite sides of the spools as are the corresponding cut out portions 221. Alternatively, the locking members 240 and 242 and corresponding cut out portions 221 may be on the same sides of the spools.

Figure 20B:
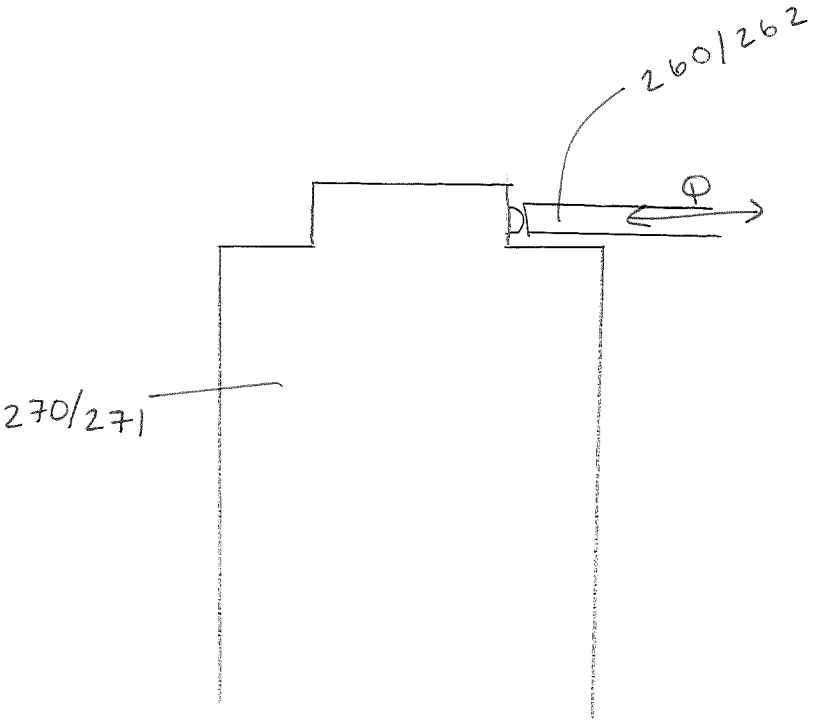
FIGS. 20*a* and 20*b* show a cross-section of a spool being biased by locking member.
Figure 20A:
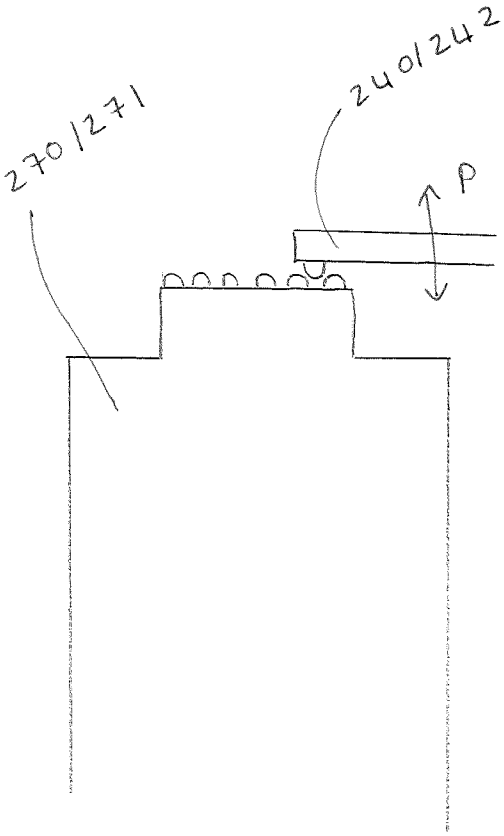

The locking members of the above embodiment are shown in FIG. 20*a*. Locking member 240/242 bias the spool 270/271 in a direction parallel to the axis of rotation to the spool as shown by P in the figure. In an alternative embodiment shown in FIG. 20*b*, there are no cut out portions in surface 8 and locking members 260 and 262 are arranged to bias the spool 270/271 in a direction perpendicular to the axis of rotation of the spool as shown by Q in FIG. 20*a*.

It should be appreciated that the subassembly also provides the print area 16. The spool adjacent to the print area 18 is the supply spool. The ink ribbon passes from the supply spool across the opening of the print area 18 and down to the take-up spool. As can be seen, the supply spool and take-up spool are in a direct line with the print area. In particular, in the assembled cassette, the image receiving medium supply is arranged to one side of the print area with the ink ribbon take-up and supply spools arranged in a straight line below the print area. This is advantageous in that a compact arrangement of the cassette can be achieved.

Reference is made to FIGS. 17*a* and *b*. The cassette receiving bay has a fixed print head 322 and a platen 324. The platen is arranged to be rotatable about its axes. The platen is also arranged to be moveable towards the print head 322. The print head 322 is arranged to be accommodated in the print area 18 of the cassette. The image receiving medium and the ink ribbon are arranged to pass and overlap between the print head 322 and the platen 324. The print zone is thus defined between the print head 322 and the platen 324.

In this embodiment, the print head 322 is fixed in position and the platen is moveable. However, in alternative embodiments of the present invention, the platen may be fixed in position, for example only able to rotate about its axis when the print head moves between the printing and a nonprinting position. In a further alternative embodiment, both the print head and the platen may be arranged to be moved one towards the other so as to be moved from for example a nonprinting position to a printing position.

Also provided in the cassette receiving bay 320 is a first ink ribbon member 326 and a second ink ribbon member 328. The first ink ribbon member 326 is arranged to engage the ink ribbon supply spool whilst the second ink ribbon member 328 is arranged to engage the ink ribbon take-up supply spool. One or both of these members may be driven so as to able to drive the ink ribbon forwards and/or in the reverse direction.

As can be seen, the cassette receiving bay has a cover 332 (shown in dotted lines) which controls the movement of the platen towards the print head. When the cover 332 is open, the platen and print head are separated so that a cassette can be easily inserted. However, when the cover is closed, the platen is moved towards the print head.

Figure 10:
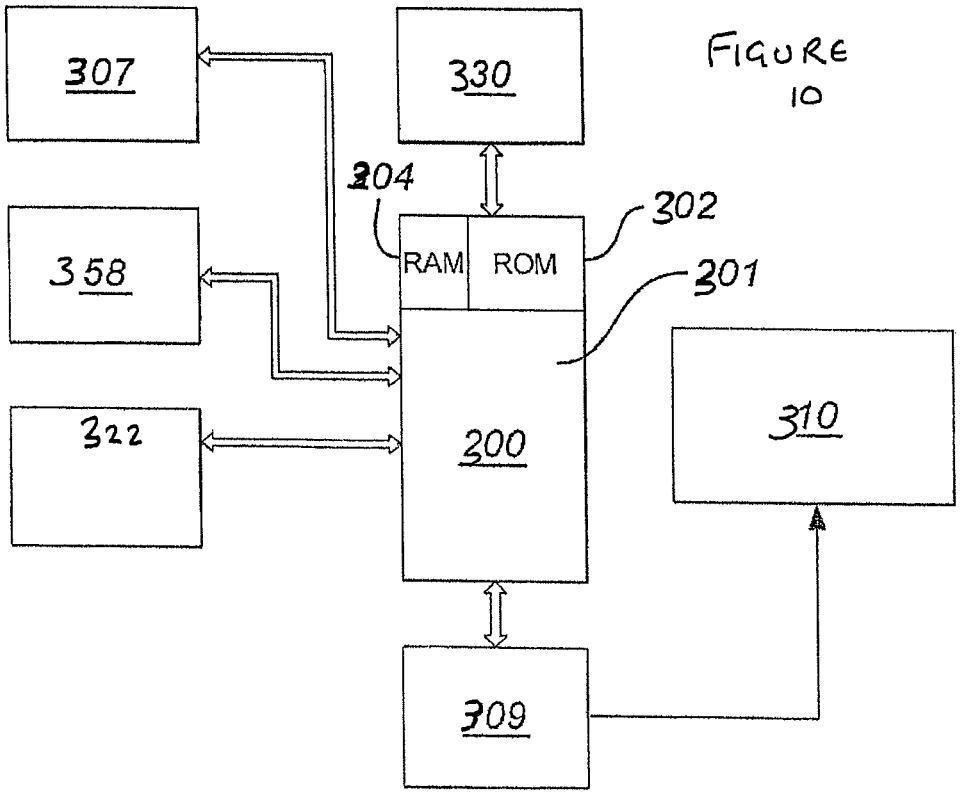
FIG. 10 shows schematically the elements of a label printer.

Reference is made to FIG. 10 which shows basic circuitry for controlling the label printer. There is a microprocessor chip 300. In practice there may be more than one chip. This chip is shown diagrammatically as having read-only memory 302, a processing part 301 and random access memory capacity indicated diagrammatically by RAM 304. However, this is by way of example and different memory and processing arrangements may be used in alternative embodiments. The microprocessor chip or chips are arranged to receive label data from a data input device such as a keyboard. Alternatively or additionally, the data input device may comprise a touch screen and/or a data port (e.g. a USB port) arranged to receive data from a PC or the like.

The microprocessor chip or chips 300 are arranged to output data to drive a display 310 via a display driver 309. That display may display a label to be printed (or a part thereof) and/or a message for the user. This display may for example be a LCD display or a touch screen. The display driving capacity may be provided as part of the microprocessor chip or chips.

The microprocessor chip or chips are also arranged to output data to drive the print head 322 so that label data is printed onto the image receiving medium to form a label.

The microprocessor chip or chips 300 may also control a motor 307 for driving the image receiving medium.

Finally, the microprocessor chip or chips may also control a cutting mechanism 358 to allow a length of tape to be cut off. In alternative embodiments of the present invention, a manual cutter may alternatively be provided.

In one embodiment of the present invention, the label printer is a stand-alone printer. This stand-alone printer may operate independently or may be connected to receive data from a PC. In alternative embodiments of the present invention, the label printer may be a PC printer and as such, the keyboard and display may be omitted as the data may be input and displayed on the PC. The PC then acts as an input device for the printer.

The present disclosure may include any feature or combination of features disclosed herein either implicitly or explicitly or any generalisation thereof without limitation to the scope of any of the present claims. In view of the foregoing description it will be evident to a person skilled in the art that various modifications may be made within the scope of the invention as defined by the claims.

The invention claimed is:

1. A label printer cassette comprising:

at least one supply of printing medium;

a housing, said housing comprising a base, a top, said top being opposite said base, and at least one side extending between said base and said top, one side having a switch operating arrangement having a first ramped surface and a second ramped surface which are configured, in use, to operate a switch of a label printer, wherein each of said first and second ramped surfaces projects from said one side in a plane arranged at right angles to a plane containing said one side, said switch operating arrangement being symmetrical about a central line bisecting said one side, said first and second ramped surfaces converging towards said central line.

2. A cassette as claimed in claim 1, wherein said switch operating arrangement comprises a positioning surface.

3. A cassette as claimed in claim 2, where said positioning surface is planar and is parallel to a plane of the base and a plane of top.

4. A cassette as claimed in claim 3, wherein said switch operating arrangement comprises an opening in said positioning surface.

5. A cassette as claimed in claim 4, wherein the opening extends in a direction parallel to an axis extending between the base and the top.

6. A cassette as claimed in claim 1, comprising a positioning arrangement spaced from said switch operating arrangement.

7. A cassette as claimed in claim 6, wherein said positioning arrangement comprises a positioning surface.

8. A cassette as claimed in claim 7, where said positioning surface of said positioning arrangement is planar and is parallel to a plane of the base and a plane of said top.

9. A cassette as claimed in claim 8, wherein said positioning arrangement comprises an opening in said positioning surface.

10. A cassette as claimed in claim 9, wherein the opening in said positioning arrangement extends in a direction parallel to an axis extending between the base and the top.

11. A cassette as claimed in claim 1, wherein said position of said ramped surface is dependent on a characteristic of said printing medium.

12. The cassette as claimed in claim 1, wherein the two ramps meet at the central line to define a V-shaped area.

13. In combination, a label printer having: a cassette receiving bay configured to receive a cassette, a print head arranged in the cassette receiving bay; and a platen arranged in the cassette receiving bay, wherein said cassette receiving bay has a base surface and at least one side, wherein at least one of said sides is provided with a switch, the position of which is controlled by a cassette, when in the cassette receiving bay; wherein said switch is biased in a neutral position when there is no cassette present in the cassette receiving bay, said switch being movable in a first direction away from said neutral position when a first cassette is inserted in the cassette receiving bay, and said switch being movable in a second, different direction away from the neutral position when a second cassette is inserted in the cassette receiving bay, said first and second cassettes being different, with a cassette received in the cassette receiving bay, the cassette comprising at least one supply of printing medium; a housing, said housing comprising a base, a top, said top being opposite said base, and at least one side extending between said base and said top, one side having a switch operating arrangement having a first ramped surface and a second ramped surface which are configured, in use to operate a switch of the label printer, wherein said first and second ramped surfaces project from said one side in a plane arranged at right angles to a plane containing said one side, said switch operating arrangement being symmetrical about a central line bisecting said one side, said switch operating arrangement being symmetrical about a central line bisecting said one side, said first and second ramped surfaces converging towards said central line.

* * * * *